United States Patent [19]

Rowe

[11] 4,139,797

[45] Feb. 13, 1979

[54] COLOR TELEVISION SCREEN AND SHADOW MASK ASSEMBLY HAVING INCREASED TOLERANCE TO RADIAL REGISTRATION ERRORS

[75] Inventor: William A. Rowe, Palatine, Ill.

[73] Assignee: Zenith Radio Corporation, Glenview, Ill.

[21] Appl. No.: 812,035

[22] Filed: Jul. 1, 1977

[51] Int. Cl.[2] ..... H01J 29/07; H01J 29/32; H01J 31/20

[52] U.S. Cl. ..... 313/408; 313/472

[58] Field of Search ..... 313/402, 408, 472, 403

[56] References Cited

U.S. PATENT DOCUMENTS

| | | | |
|---|---|---|---|
| 2,947,899 | 8/1960 | Kaplan | 313/408 |
| 3,590,303 | 6/1971 | Coleclough | 313/402 X |
| 3,705,322 | 12/1972 | Naruse et al. | 313/408 |
| 3,890,527 | 6/1975 | Patel et al. | 313/472 X |

FOREIGN PATENT DOCUMENTS

| | | | |
|---|---|---|---|
| 2151873 | 4/1973 | Fed. Rep. of Germany | 313/408 |

*Primary Examiner*—Robert Segal
*Attorney, Agent, or Firm*—John H. Coult; Ralph E. Clarke, Jr.

[57] ABSTRACT

This disclosure depicts a novel apparatus for use in a shadow mask type color television picture tube having a funnel and a faceplate attached to the mouth of the funnel. The faceplate has an electron excitable phosphor screen having triads of red, green and blue phosphor elements deposited thereon and an apertured shadow mask in spaced adjacency to the phosphor screen. The funnel has a neck containing an electron gun assembly for forming three electron beams. The apertures in the shadow mask form beam landing areas on the phosphor elements when the electrons pass through the apertures. This invention is a system for increasing color purity tolerance and leaving tolerance in at least a portion of a predetermined sector of the phosphor screen and shadow mask assembly to increase tolerance to radial registration errors between the electron beam landing areas and the phosphor elements due to shadow mask doming during operation of the tube. The geometry of the beam landing areas and the phosphor elements in the portion of the sector are characterized by having off the tube axis the smaller ones of the phosphor elements and the mask apertures radially compressed relative to the larger ones without a corresponding azimuthal compression. The radial compressing increases with increasing radius such that the tolerances in the radial direction increase off axis without a corresponding increase in azimuthal tolerance. This provides increased tolerance to the aforesaid doming-induced registration errors between the phosphor elements and the beam landing areas.

5 Claims, 18 Drawing Figures

COLOR TELEVISION SCREEN AND SHADOW MASK ASSEMBLY HAVING INCREASED TOLERANCE TO RADIAL REGISTRATION ERRORS

BACKGROUND OF THE INVENTION

This invention relates generally to color television picture tubes and more particularly to such tubes which utilize an aperture or shadow mask structure for selectively directing an electron beam onto a fluorescent screen.

Various types of color tubes for television receivers have been suggested and fabricated. One of the more frequently used types includes means for selectively directing an electron beam or beams through the apertures in a metal mask structure to impinge upon selected areas of a luminescent screen, which screen may comprise discrete phosphor dots disposed in a mosaic layer on the faceplate of a cathode-ray tube. Three such dots normally constitute an elementary phosphor triad, comprising a red, a green and a blue phosphor dot, the dots being tangent to each other and ideally disposed so that the phosphor dot centers are coincident with the apexes of an equilateral triangle. By directing an electron beam through a given mask aperture at a predetermined angle, a particular one of the sub-elemental phosphor dots in an elementary triad can be excited to give off energy at a particular wavelength, i.e., indicate a particular color. In this manner the three primary colors are reproduced, and simultaneous excitation of two or three dots in the same triad is effective to produce other hues.

A color television picture tube may utilize three separate electron guns, or by switching the beam from a single gun may, in effect, provide three separate electron beams; these beams are deflected in a well known manner to pass through the mask apertures and impinge on and excite certain of the phosphor dots. The three beams are considered as originating in a common plane, perpendicular to the axis of the tube, which plane is denominated the plane-of-color-centers. When one of the three electron beams is directed through a certain mask aperture to excite a particular phosphor dot, it is desirable that the circular beam landing area be centered on the particular phosphor dot.

During operation of the color television picture tube, electrons in the electron beams strike the shadow mask. The electrons which strike the shadow mask cause the temperature of the shadow mask to increase. As the shadow mask increases in temperature the metal of the shadow mask expands causing the shadow mask to "dome" forward towards the phosphor screen of the faceplate. Doming of the shadow mask during normal operation of the tube is sufficient to induce registration errors between the beam landing areas and the phosphor dots. That is, a beam landing area may be shifted so as to impinge an adjacent color phosphor dot, producing a color purity error, or to leave altogether the targeted dot, producing a white field non-uniformity or "leaving" error.

A number of patents reveal attempts to solve the problems of triad location error, triad size error and triad shape error by the use of an elliptical configuration for the phosphor elements and/or the apertures in the shadow mask. The above-mentioned patents are; U.S. Pat. No. 2,947,899 issued to Kaplan, U.S. Pat. No. 3,663,854 issued to Tsuneta et al., U.S. Pat. No. 3,581,136 issued to Staunton, U.S. Pat. No. 3,705,322 issued to Naruse et al., and U.S. Pat. No. 3,777,204 issued to Robbins et al. These patents, however, have not addressed themselves to the problem of radial misregistration between beam landing areas and phosphor elements due to doming during operation of a tube.

The novel phosphor screen and shadow mask of the present invention overcome the problem of radial registration errors caused by doming of the shadow mask. This invention has general applicability, but is most advantageously applied to a shadow mask type color television picture tube having a delta-type electron gun assembly or an in-line type electron gun assembly wherein the phosphor screen of the tube is of the dot type, as opposed to a line type.

OBJECTS OF THE INVENTION

It is a general object of the present invention to provide for a color television picture tube an improved phosphor screen and shadow mask.

It is a more specific object of the present invention to provide a phosphor screen and shadow mask having increased radial tolerance to radial registration errors between beam landing areas and phosphor elements of the phosphor screen, which errors are induced by doming of the shadow mask during operation of the tube.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings in the several figures of which like reference numerals identify like elements and in which:

FIG. **14*a*** schematically illustrates an embodiment of the present invention for an in-line dot-type phosphor screen;

FIG. **14*b*** schematically illustrates an associated shadow mask.

FIG. 15 schematically illustrates an embodiment of the present invention for a delta dot-type phosphor screen.

DESCRIPTION OF THE PREFERRED EMBODIMENT

Figure 1:
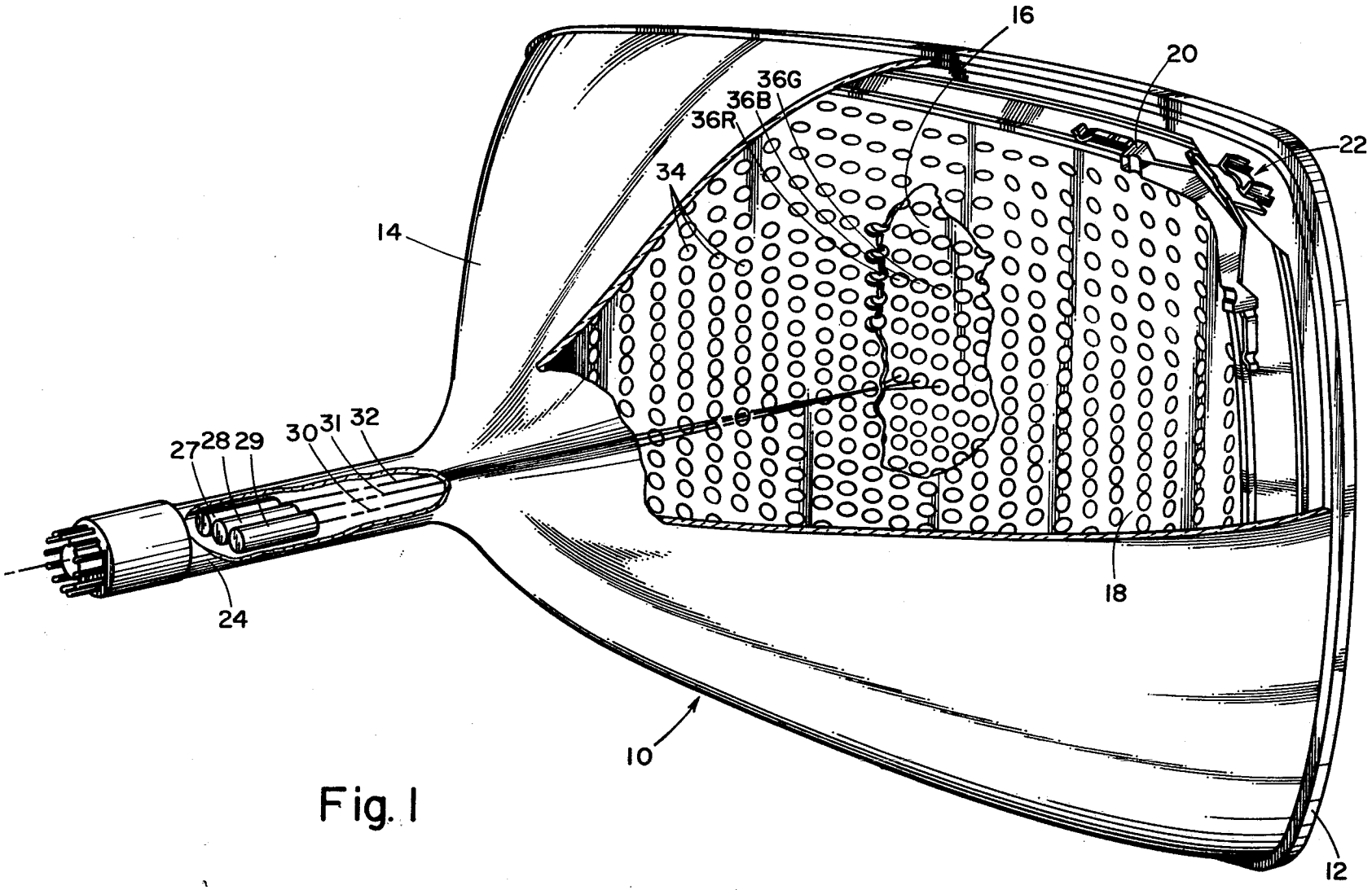
FIG. 1 is a partly broken away perspective view of a unique color television picture tube having a funnel and a flangeless faceplate sealed to the mouth of the funnel; the tube also has an apertured shadow mask and a phosphor screen having discrete phosphor elements.

This invention pertains to a system for increasing color purity tolerance and leaving tolerance for a color television picture tube without unnecessarily reducing picture brightness. A color television picture tube to which this invention is applied is illustrated in FIG. 1. A faceplate 12 of a tube 10 is attached to the mouth of a funnel 14. The faceplate 12 has an electron-excitable phosphor screen 16 wherein the screen has triads of red, green and blue phosphor elements deposited thereon. An apertured shadow mask 18 is supported in spaced adjacency to the phosphor screen 16 by means of a mask suspension system 20 and engaging studs 22 embedded in the inner surface of the faceplate 12. The funnel 14 has a neck 24 which contains an electron gun assembly 26. The electron gun assembly 26 has three electron guns 27, 28 and 29 (here shown as an in-line type of electron gun assembly), the three guns 27, 28 and 29 generating three electron beams 30, 31 and 32. Apertures 34 in the shadow mask 18 create beam landing areas on the phosphor elements 36 of the phosphor screen 16 when the electron beams 30, 31 and 32 pass through the apertures 34.

Figure 2:
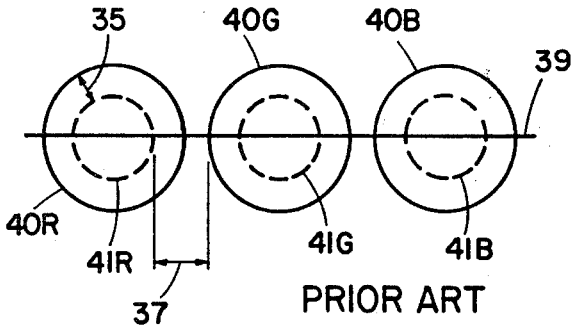
FIGS. 2–5 schematically illustrate triads of red, green and blue phosphor elements and their associated electron beam landing areas as are typically found in the prior art.

FIG. 2 illustrates a typical phosphor element triad of the in-line variety as is found in the prior art. The phosphor elements 40R, 40G and 40B are aligned so that their centers lie on a common straight line 39. As illustrated in FIG. 2, the beam landing areas 41R, 41G and 41B are smaller in size than the phosphor elements 40R, 40G and 40B (this is also known as positive guard band). In this illustration the phosphor elements 40R, 40G, 40B and the beam landing areas 41R, 41G, 41B are concentric circles.

Figure 3:
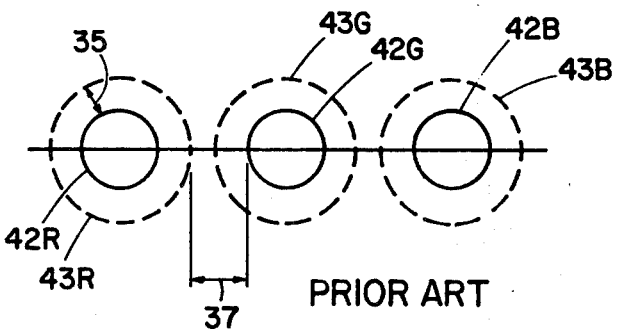

FIG. 3 shows negative guard band tolerance wherein the beam landing areas 43R, 43G and 43B are larger than their corresponding phosphor elements 42R, 42G and 42B. For either positive or negative guard band conditions the distance 35 between the circumference of a beam landing area to the circumference of the corresponding phosphor element is termed the leaving tolerance. Also illustrated in FIGS. 2 and 3 is a color purity tolerance 37, which is the distance from one beam landing area to the adjacent phosphor element.

Figure 4:
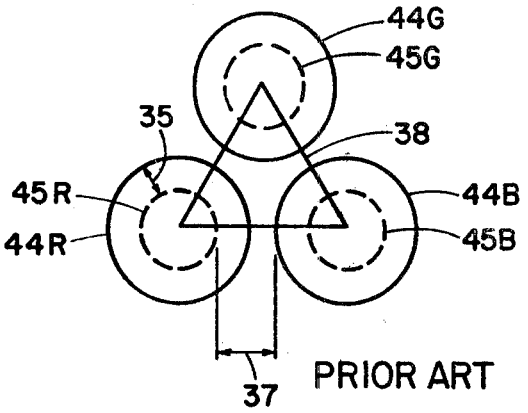

FIG. 4 shows the arrangement of a phosphor element triad located near the center of the screen for use with a delta-type electron gun assembly. As illustrated in FIG. 4, the phosphor elements 44R, 44G and 44B are arranged so that the centers of the circular phosphor elements lie at the apexes of an equilateral triangle 38. FIG. 4 shows the beam landing areas 45R, 45G and 45B being smaller in size than their corresponding phosphor elements 44R, 44G and 44B (positive guard band).

Figure 5:
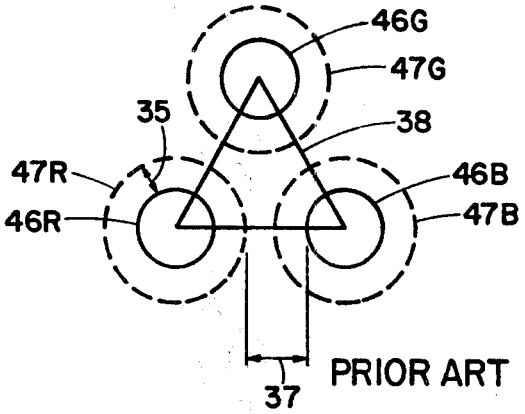

FIG. 5 illustrates negative guard band tolerance wherein beam landing areas 47R, 47G and 47B are larger than their corresponding phosphor elements, 46R, 46G and 46B. As noted, this illustrates a negative guard band condition for a delta-type electron gun assembly. Distance 35 is the leaving tolerance and distance 37 is the color purity tolerance. The beam landing areas illustrated in FIGS. 2–5 are formed by the electron beam passing through circular apertures in the shadow mask.

Figure 6:
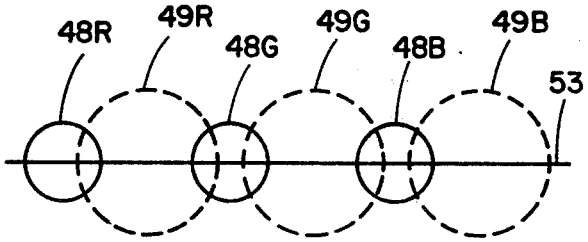
FIGS. 6 and 7 show the effect of doming of the shadow mask on the registration relationship of the electron beam landing areas and the phosphor elements.
Figure 7:
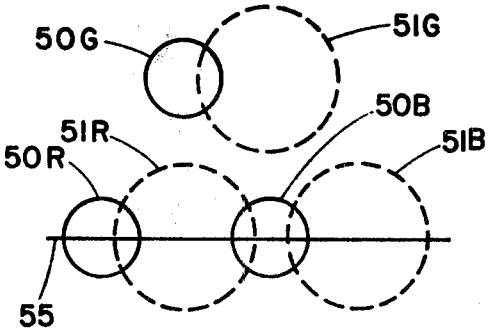

FIGS. 6 and 7 illustrate the problem of doming for both an in-line type triad (FIG. 6) and a delta-type triad (FIG. 7). The FIG. 6 in-line triad is located at the 3 or 9 o'clock position on the phosphor screen 16, straight line 53 being a radial of the phosphor screen 16. Likewise the FIG. 7 delta triad is located at the 3 or 9 o'clock position and straight line 55 is a radial of the phosphor screen 16. The effect of doming of the shadow mask is that the electron beam landing areas are moved from their correct position. In some cases this movement can be quite severe and, as illustrated in FIG. 6, it is possible for electron beam landing areas 49R, 49G and 49B to impinge adjacent phosphor elements. Therefore, for example, beam landing areas 49R now impinges not only phosphor element 48R, but also phosphor element 48G. As a result, the light output for phosphor element 48R has been diminished and phosphor element 48G is caused to emit light, thereby causing color impurity in the image on the phosphor screen 16. Similarly, FIG. 7 illustrates the effect of doming on a delta-type phosphor triad. In both cases the movement of the beam landing areas occurs along radials of the phosphor screen 16.

Figure 8A:
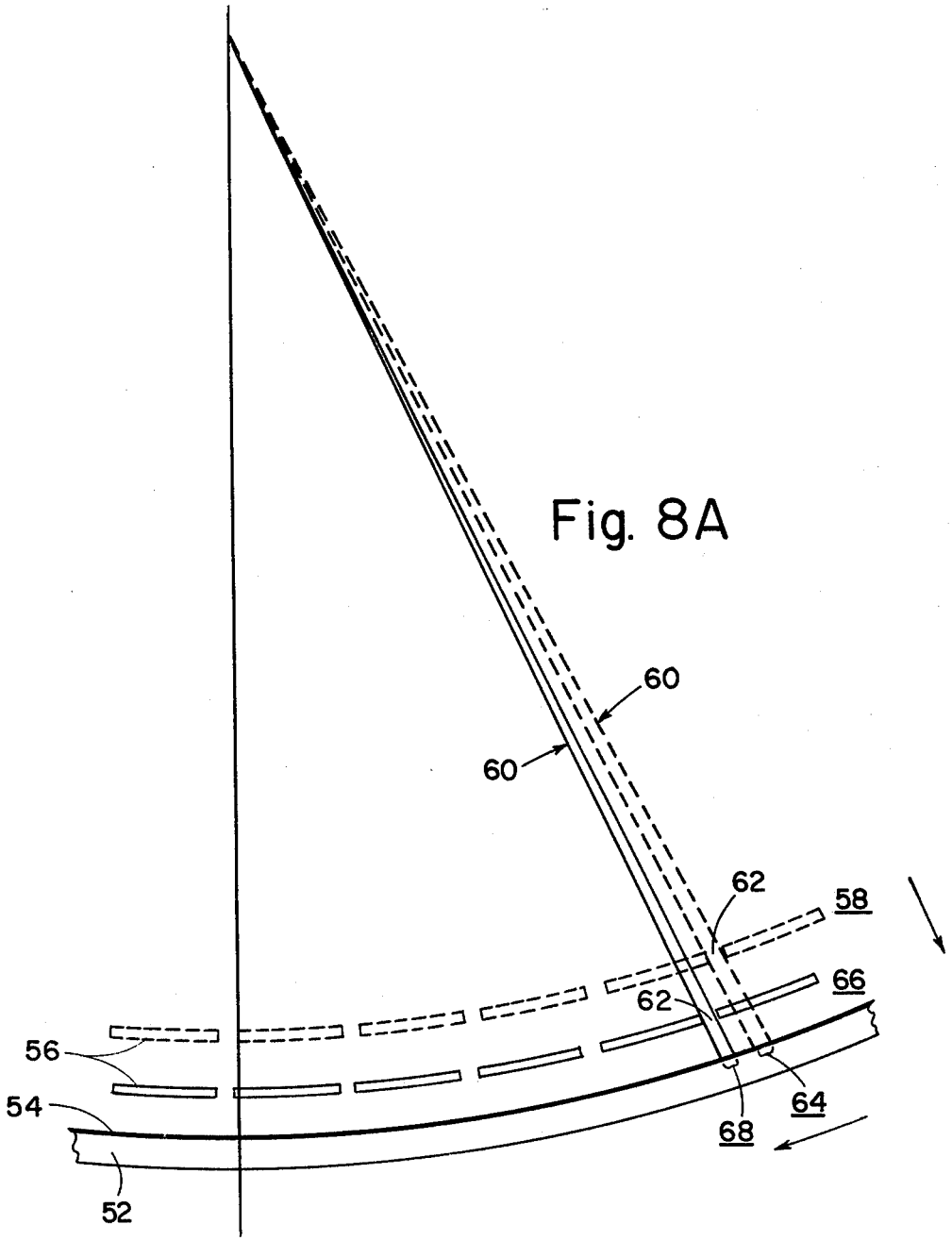
FIGS. 8A and 8B schematically illustrate the effect of doming on the electron beam trajectory in the color television pictore tube.
Figure 8B:
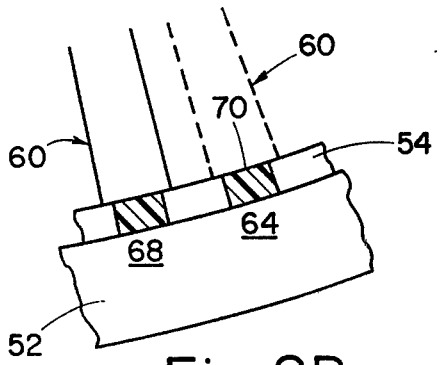

FIG. 8A is a schematic illustration of a faceplate 52 having a phosphor screen 54 deposited on its inner surface and a shadow mask 56 spaced in close adjacency thereto. Before doming of the shadow mask or a portion of shadow mask 56 occurs, the shadow mask 56 occupies position 58. An electron beam 60 passing through aperture 62 of the shadow mask 56 strikes the phosphor screen 54 at location 64. During operation of a color television picture tube, when the picture information causes a bright area to appear on the phosphor screen, the electrons striking the shadow mask 56 may cause doming. That is, the shadow mask 56 will expand, causing the shadow mask 56 to move towards the faceplate 52. After doming has occurred, the shadow mask occupies position 66. The electron beam passing through aperture 62 now strikes the phosphor screen 54 at location 68 instead of location 64. FIG. 8B illustrates the shift of the electron beam with doming in greater detail. In FIG. 8B it can be observed that the electron beam 60 has moved from an original position 64 of impinging phosphor element 70 to a new position 68 wherein the electron beam 60 impinges a different phosphor element 72. This is an extreme condition, but it illustrates the point. In this situation, due to mask doming, the wrong phosphor element is being caused to emit light.

FIGS. 9–13 schematically illustrate pairs of phosphor elements with their corresponding beam landing areas. For use of explanation, these phosphor elements are located off the tube axis at the 3 or 9 o'clock positions on the phosphor screen 16 and the centers of the phosphor elements lie on a radial 57. In the following discussion reference to an azimuthal direction refers to a direction perpendicular to radial 57.

Figure 9:
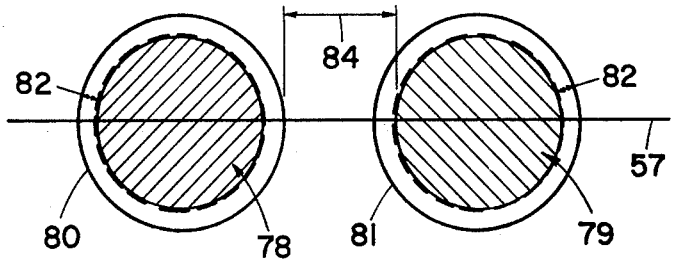
Fig. 9 PRIOR ART
FIGS. 9 and 10 schematically illustrate typical prior art electron beam landing areas and phosphor elements.
Figure 10:
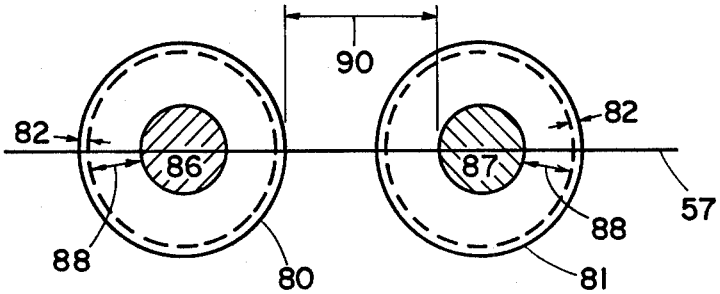
Fig. 10 PRIOR ART

FIG. 9 illustrates a pair of adjacent circular phosphor elements 78 and 79 with their corresponding beam landing areas 80 and 81, the beam landing areas 80 and 81 being larger than the phosphor elements 78 and 79. A first leaving tolerance 82 is provided between the phosphor elements 78, 79 and their corresponding beam landing areas 80, 81 to provide for manufacturing and other tolerances. A color purity tolerance 84 is provided between the phosphor elements and adjacent beam landing areas so that when conditions occur causing the beam landing areas to move, there will be some distance that the beam landing area can move before impinging an adjacent phosphor element. FIG. 10 illustrates a pair of adjacent phosphor elements 86 and 87 which are reduced in size from phosphor elements 78 and 79, thus allowing an additional leaving tolerance 88 and an increased color purity tolerance 90 to provide for the effects of doming.

The present invention will now be described. The invention is for use in a shadow mask type color television picture tube. The faceplate has an electron-excitable phosphor screen having triads of red, green and blue phosphor elements deposited thereon and an apertured shadow mask in spaced adjacency to the phosphor screen. The funnel has a neck containing an electron gun assembly for forming three electron beams. The apertures in the shadow mask form beam landing areas on the phosphor elements when the electrons pass through the apertures. This invention comprises a system for increasing color purity tolerance and leaving tolerance in at least a portion of a predetermined sector of the phosphor screen and shadow mask assembly to increase tolerance to radial registration errors between the electron beam landing areas and the phosphor elements due to shadow mask doming during operation of the tube. This is accomplished without wasting potential picture brightness by providing unnecessary azimuthal leaving and/or color purity tolerance. The geometry of the beam landing areas and the phosphor elements in the portion of the sector are characterized by having off the tube axis a smaller ones of the phosphor elements and the mask apertures radially compressed relative to the larger ones without a corresponding azimuthal compression. The radial compressing increases with increasing radius such that the tolerances in the radial direction increase off axis without a corresponding increase in axial tolerance. This provides increased tolerance to the aforesaid doming induced registration errors between the phosphor elements and the beam landing areas.

It has been observed that when doming occurs the beam landing areas move substantially in a radial direction across the phosphor screen. Taking this into consideration by this invention, as illustrated in FIG. 11, the azimuthally directed portions of the phosphor elements 82 and 93 need not be reduced in order to increase tolerance to radial registration errors.

Figure 11:
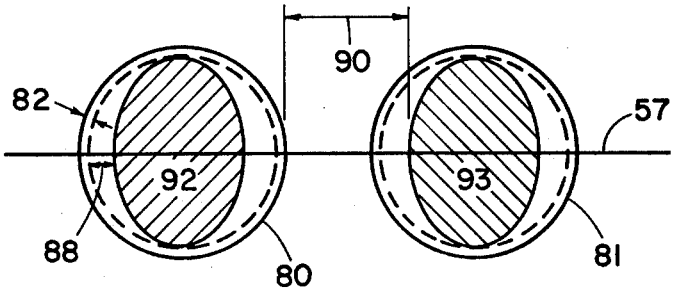
FIGS. 11–13 schematically illustrate the present invention.
Figure 12:
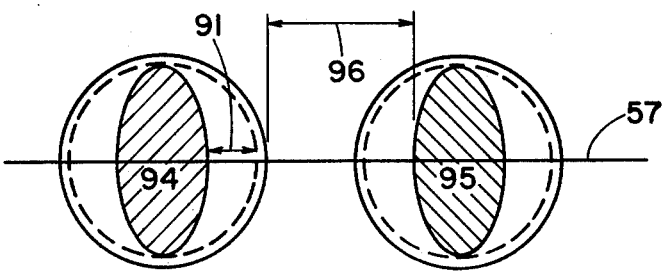

In FIG. 11 the phosphor elements 92 and 93 are radially compressed as compared to beam landing areas 80, 81. It is important to note that leaving tolerance 82 has been preserved in the azimuthal direction of the radially compressed phosphor elements 92 and 93 for the above stated reasons. Since the fully excited phosphor elements 92 and 93 have a greater area than phosphor dots 86 and 87, there will be a greater picture brightness with this type of embodiment without a loss in needed color purity tolerance. FIG. 12 illustrates that with only a small loss in brightness phosphor elements 94 and 95 can be made more radially compressed than phosphor elements 92 and 93 thus increasing to an even greater extent the color purity tolerance 96 and the radially directed leaving tolerance 91.

Figure 13:
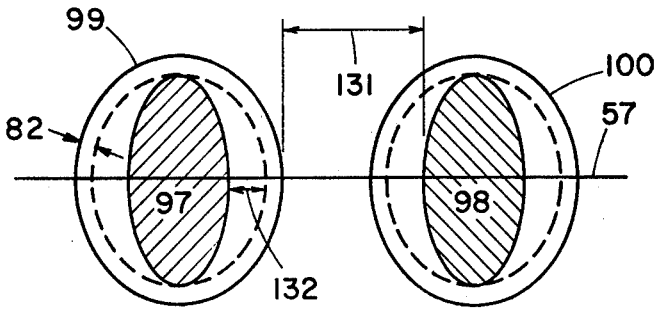

Conventionally, in the manufacture of color television picture tubes the shadow mask is used to form the phosphor elements of the phosphor screen on the inside surface of the faceplate. In order to facilitate the forming of radially compressed phosphor elements as shown in FIGS. 11 and 12, the apertures in the shadow mask may also be radially compressed. As a result, the electron beam landing areas also take on an elongated or elliptical shape in the azimuthal direction. FIG. 13 illustrates an embodiment of the present invention which has elliptical phosphor elements 97 and 98 and elliptical beam landing areas 99 and 100. The needed color purity tolerance 131 is provided in the radial direction on radial 57, thereby also providing leaving tolerance 132 in addition to original leaving tolerance 82. In this embodiment both the phosphor elements and the mask apertures are radially compressed without a corresponding azimuthal compression. The smaller one of the phosphor elements and the mask apertures is radially compressed to a greater degree than the larger one of the phosphor elements and the mask apertures.

It is important to note that although FIGS. 9–13 have been discussed in terms of negative guard band, the present invention is equally applicable to phosphor screens having positive guard band. For example, in FIG. 12 the elliptically shaped areas 94, 95 can represent electron beam landing areas and the circular areas 80, 81 can represent phosphor elements. Elliptical beam landing areas can be formed by an electron beam passing through elliptical apertures in the shadow mask. In general, then, in accordance with the invention, to provide increased tolerance to doming, the smaller ones of the phosphor elements and the mask apertures are increasingly radially compressed off-axis relative to the larger ones without a corresponding azimuthal compression, irrespective of the initial geometry of the elements and beam landing areas. In general, the radial compression of the phosphor elements and/or the mask apertures causes the phosphor elements and/or the mask apertures to have a substantially elliptical configuration, wherein the minor axes of the phosphor elements and/or the mask apertures are radially oriented on the phosphor screen.

Figure 14A:
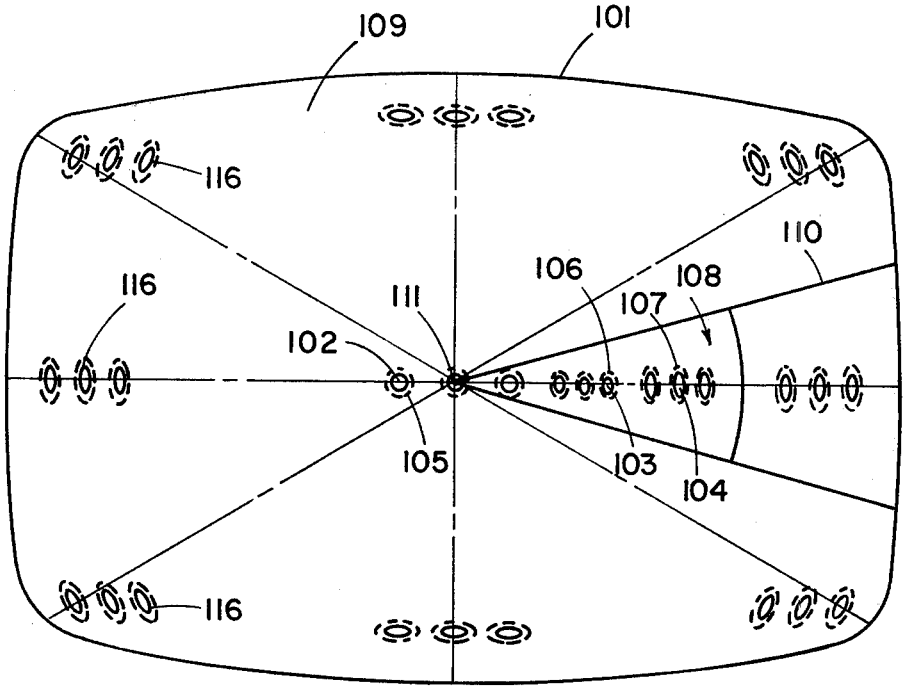
Figure 14B:
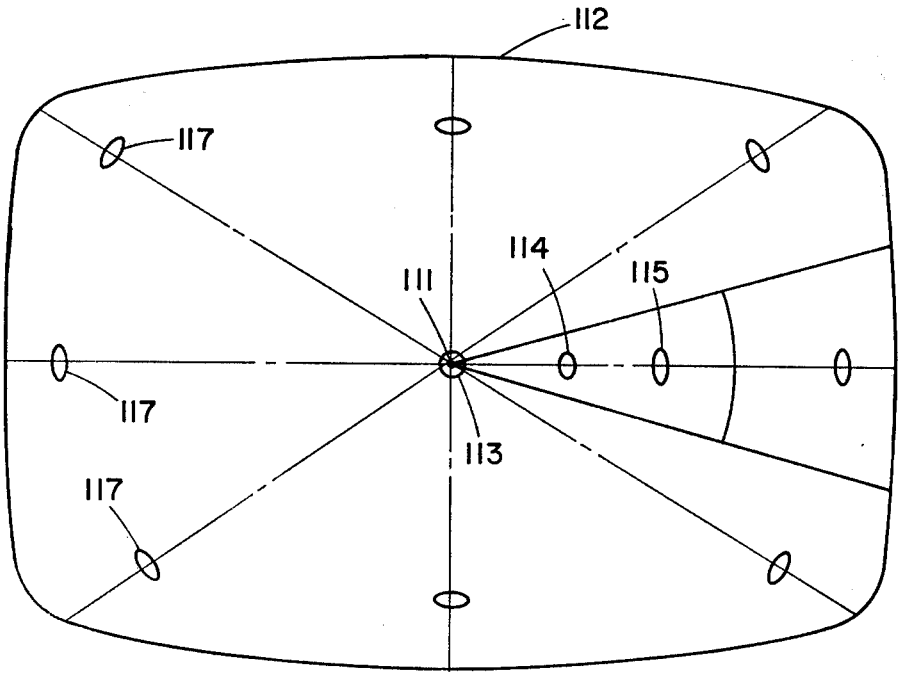

FIGS. 14A and 14B schematically illustrate a preferred embodiment of the present invention. In FIG. 14A a faceplate 101 has deposited on its inner surface a phosphor screen 109. Phosphor elements 102, 103 and 104 are illustrated with their corresponding beam landing areas 105, 106 and 107. The present invention is a system for increasing color purity tolerance and leaving tolerance in at least a portion 108 of a predetermined sector 110 of the phosphor screen 109 (FIG. 14A) and shadow mask 112 (FIG. 14B) assembly to increase tolerance to radial registration errors between the electron beam landing areas 105, 106, 107 and the phosphor elements 102, 103, 104 due to shadow mask doming during operation of the tube. The geometry of the beam landing areas 105, 106 and 107 and the phosphor elements 102, 103, 104 in the portion 108 of the sector 110 is characterized by having on the tube axis 111 in the preferred embodiment substantially circular phosphor elements 102 on the phosphor screen 109 and substantially circular apertures 113 in the shadow mask 112. In the portion 108 of the sector 110 off the tube axis 111, the phosphor element is radially compressed to a greater degree than the corresponding mask aperture. The radial compression without a corresponding azimuthal compression causes the phosphor elements and the mask apertures off the tube axis to have a substantially elliptical configuration. The radial compressing increases with increasing radius such that the tolerances in the radial direction increase off-axis without a corresponding increase in azimuthal tolerance. (Phosphor element 104 is more compressed, that is it has a greater ellipticity, than phosphor element 103; likewise, aperture 115 is more elliptical than aperture 114). This provides increased tolerance to the aforesaid doming induced registration errors between the phosphor elements and the beam landing areas. Elliptically shaped phosphor elements 116 illustrate that the minor axes of these elliptical elements are oriented to be aligned with radials of the phosphor screen 109, while the centers of the phosphor elements 116 of each triad lie on horizontal lines. Similarly, elliptical apertures 117 in the shadow mask 112 are oriented such that they are radially compressed, that is, their minor axes are oriented to align with radials of the shadow mask 112.

Figure 15A:
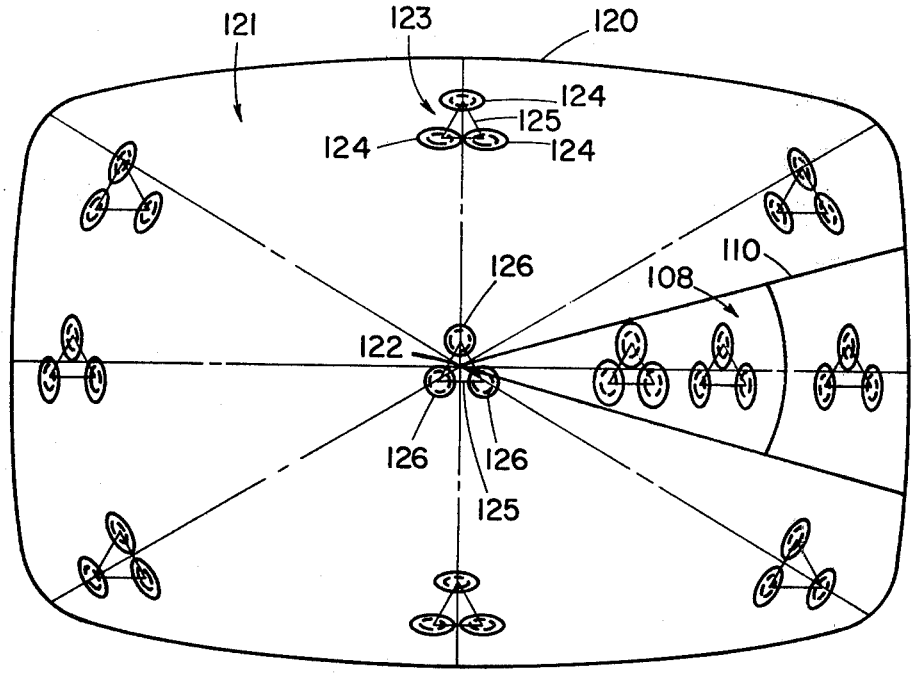
Figure 15B:
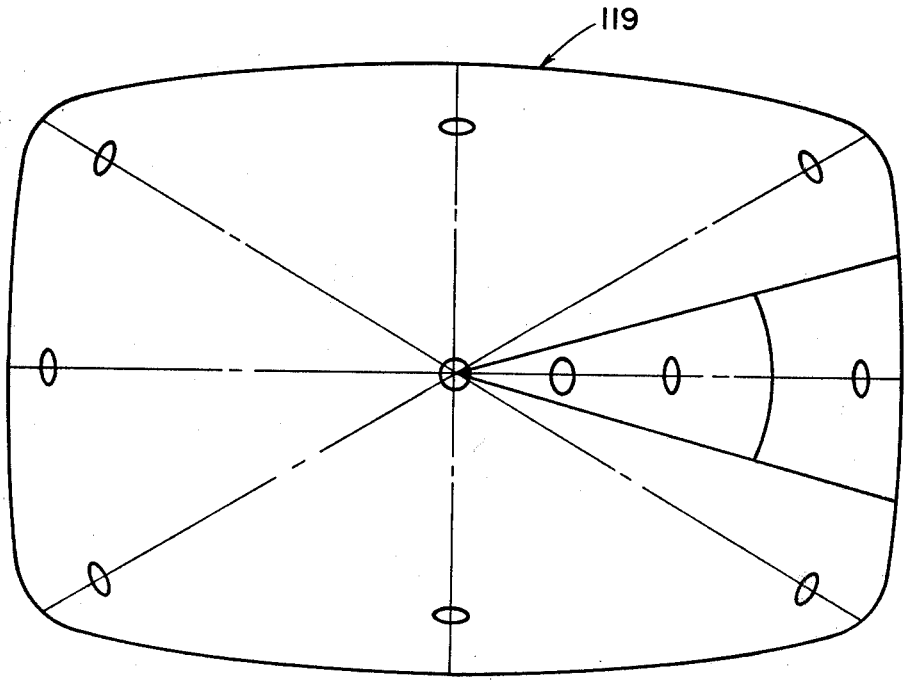

FIGS. 15A and 15B illustrate an embodiment of the present invention for a shadow mask 119 and a phosphor screen 121 on a faceplate 120 for use with a delta-type electron gun assembly and having a positive guard band. The phosphor triads 123 which form the phosphor screen 121 have phosphor elements 124, 126, the centers of which are oriented to lie at the apexes of equilateral triangles 125.

The embodiments depicted in FIGS. 14A and 14B, as well as FIGS. 15A and 15B, have circular phosphor elements and shadow mask apertures on the tube axis. This is not a limitation of the present invention and the phosphor elements and the shadow mask apertures on the tube axis may have an elliptical configuration, as well as other configurations.

The invention is not limited to the particular details of the apparatus depicted and other modifications and applications are contemplated. Certain changes may be made in the above-described apparatus without departing from the true spirit and scope of the invention herein involved. It is intended, therefore, that the subject matter in the above depiction shall be interpreted as illustrative and not in a limiting sense.

What is claimed is:

1. For use in a shadow mask type color television picture tube having a funnel and a faceplate attached to the mouth of said funnel wherein said faceplate has an electron excitable phosphor screen having triads of red, green and blue phosphor elements deposited thereon and an apertured shadow mask in spaced adjacency to said phosphor screen and wherein said funnel has a neck containing an elecron gun assembly for forming three electron beams, said apertures in said shadow mask forming beam landing areas on said phosphor elements when said electron beams pass through said apertures, a system for increasing color purity tolerance and leaving tolerance in at least a portion of a predetermined sector of the phosphor screen and shadow mask assembly to increase tolerance to radial registration errors between said electron beam landing areas and said phosphor elements due to shadow mask doming during operation of said tube, the geometry of said beam landing areas and phosphor elements in said portion of said sector being characterized by having off the tube axis the smaller ones of said phosphor elements and said mask apertures radially compressed relative to the larger ones without a corresponding azimuthal compression, and said radial compressing increasing with increasing radius such that said tolerance in the radial direction increase off-axis without a corresponding increase in azimuthal tolerance, thus providing increased radial tolerance to the aforesaid doming-induced radial registration errors between the phosphor elements and the beam landing areas without unncessarily providing a commensurate increase in azimuthal tolerance which would result in wasted picture brightness.

2. For use in a shadow mask type color television picture tube having a funnel and a faceplate attached to the mouth of said funnel wherein said faceplate has an electron excitable phosphor screen having triads of red, green and blue phosphor elements deposited thereon and an apertured shadow mask in spaced adjacency to said phosphor screen and wherein said funnel has a neck containing an electron gun assembly forming three electron beams, said apertures in said shadow mask forming beam landing areas on said phosphor elements when said electron beams pass through said apertures, a system for increasing color purity tolerance and leaving tolerance in at least a portion of a predetermined sector of the phosphor screen and shadow mask assembly to increase tolerance to radial registration errors between said electron beam landing areas and said phosphor elements due to shadow mask doming during operation of said tube, the geometry of said beam landing areas and phosphor elements in said portion of said sector being characterized by having on the tube axis substantially circular phosphor elements on said phosphor screen and substantially circular apertures in said shadow mask and wherein off the tube axis the smaller ones of said phosphor elements and said phosphor elements and said mask apertures are radially compressed relative to the larger ones without a corresponding azimuthal compression, and said radial compressing increasing with increasing radius such that said tolerances in the radial direction increase off-axis without a corresponding increase in azimuthal tolerance, thus providing increased radial tolerance to the aforesaid doming-induced radial registration errors between the phosphor elements and the beam landing areas without unnecessarily providing a commensurate increase in azimuthal tolerance which would result in wasted picture brightness.

3. The apparatus defined in claim 2 wherein said portion of said sector off said tube axis both said phosphor elements and said mask apertures are radially compressed and wherein said smaller ones of said phosphor elements and said mask apertures are radially compressed to a greater degree than said larger ones of said phosphor elements and said mask apertures.

4. The apparatus defined in claim 3 wherein in said portion of said sector off said tube axis, said radial compression of said phosphor elements and/or said mask apertures causes said phosphor elements and/or said mask apertures to have a substantially elliptical configuration and wherein the minor axes of said phosphor elements and/or said mask apertures are radially oriented.

5. For use in a shadow mask type color television picture tube having a funnel and a faceplate attached to the mouth of said funnel wherein said faceplate has an electron excitable phosphor screen having triads of red, green and blue phosphor elements deposited thereon, the centers of said phosphor elements of each triad lying on a common straight line, and an apertured shadow mask in spaced adjacency to said phosphor screen and wherein said funnel has a neck containing an in-line electron gun assembly for forming three electron beams, said apertures in said shadow mask forming beam landing areas on said phosphor elements when said electron beams pass through said apertures, said beam landing areas being larger than said phosphor elements, a system for increasing color purity tolerance and leaving tolerance in at least a portion of a predetermined sector of the phosphor screen and shadow mask assembly to increase tolerance to radial registration errors between said electron beam landing areas and said phosphor elements due to shadow mask doming during operation of said tube, the geometry of said beam landing areas and phosphor elements in said portion of said sector being characterized by having on the tube axis substantially circular phosphor elements on said phosphor screen and substantially circular apertures in said shadow mask and wherein off the tube axis said phosphor elements and said mask apertures are radially compressed without a corresponding azimuthal compression, said phosphor elements being radially compressed to a greater degree than said mask apertures said radial compression causing said phosphor elements and said mask apertures to have a substantially elliptical configuration, and said radial compressing increasing with increasing radius such that said tolerances in the radial direction increase off-axis without a corresponding increase in azimuthal tolerance, thus providing increased tolerance to the aforesaid doming induced registration errors between the phosphor elements and the beam landing areas without unnecessarily providing a commensurate increase in azimuthal tolerance which could result in wasted picture brightness.

* * * * *